United States Patent [19]

Binnie

[11] 4,151,769

[45] May 1, 1979

[54] TUBE LOUVERING MACHINE

[75] Inventor: Kevin D. Binnie, Taren Point, Australia

[73] Assignee: K. D. Binnie Engineering Pty. Limited, Taren Point, Australia

[21] Appl. No.: 838,323

[22] Filed: Sep. 30, 1977

[30] Foreign Application Priority Data

Oct. 6, 1976 [AU] Australia ..... 7619/76

[51] Int. Cl.[2] ..... B26F 1/02

[52] U.S. Cl. ..... 83/181; 83/183; 83/194; 83/277; 414/745

[58] Field of Search ..... 83/54, 181, 182, 183, 83/194, 277; 266/167, 162, 149; 279/23 R; 214/1 P; 269/287

[56] References Cited

U.S. PATENT DOCUMENTS

| | | | |
|---|---|---|---|
| 2,423,791 | 7/1947 | Nelson | 83/194 X |
| 2,453,681 | 11/1948 | Temple | 83/194 X |
| 3,266,356 | 8/1966 | Seravin et al. | 83/181 |
| 3,635,111 | 1/1972 | Zieg et al. | 83/183 |
| 4,003,278 | 1/1977 | Shields | 83/277 X |

*Primary Examiner*—J. M. Meister

*Attorney, Agent, or Firm*—Ladas, Parry, Von Gehr, Goldsmith & Deschamps

[57] ABSTRACT

An apparatus to simultaneously punch a series of louver holes in a tubular workpiece. The apparatus having a series of punches angularly spaced around the workpiece, which punches are caused to reciprocate by the engagement thereof by a series of inclined surfaces of a rotatable member located around the workpiece. The apparatus further includes gripping means to hold the workpiece during punching operations and to move the workpiece in between successive punching operations.

17 Claims, 4 Drawing Figures

TUBE LOUVERING MACHINE

The present invention relates to machines for louvering tubes and more particularly, but not exclusively, to a machine for punching louver holes in tubes for motor vehicle exhaust mufflers.

In one commonly known motor vehicle exhaust muffler, a vented tube is provided in a sealed chamber. The inlet and outlet ends of the tube extend from remote ends of the chamber to enable the muffler to be connected into an exhaust system. The vent holes in the tube are fabricated by stamping to remove metal or punching to shear the metal and form a louvered opening. Conventional manufacture of the vented tube is particularly slow and hence the tubes are costly to produce.

It is an object of the present invention to provide an improved apparatus for producing louvered tubes.

The present invention in one general form is an apparatus comprising:

a body, gripping means on said body for holding a tubular workpiece, a plurality of punches slidably mounted on said body, said punches being angularly spaced around said tubular workpiece, and punch actuating means causing movement of said plurality of punches towards said workpiece to form a plurality of holes therein.

A preferred embodiment of the present invention will now be described by way of example with reference to the accompanying drawings, in which.

The machine illustrated in FIGS. 1 to 4 is arranged to punch louver holes in tubes primarily for use in motor vehicle exhaust mufflers, however, the machine may be adapted for any other suitable applications. Also the machine provides for high speed louvering of tube together with automatic spiral feed.

Figure 2:
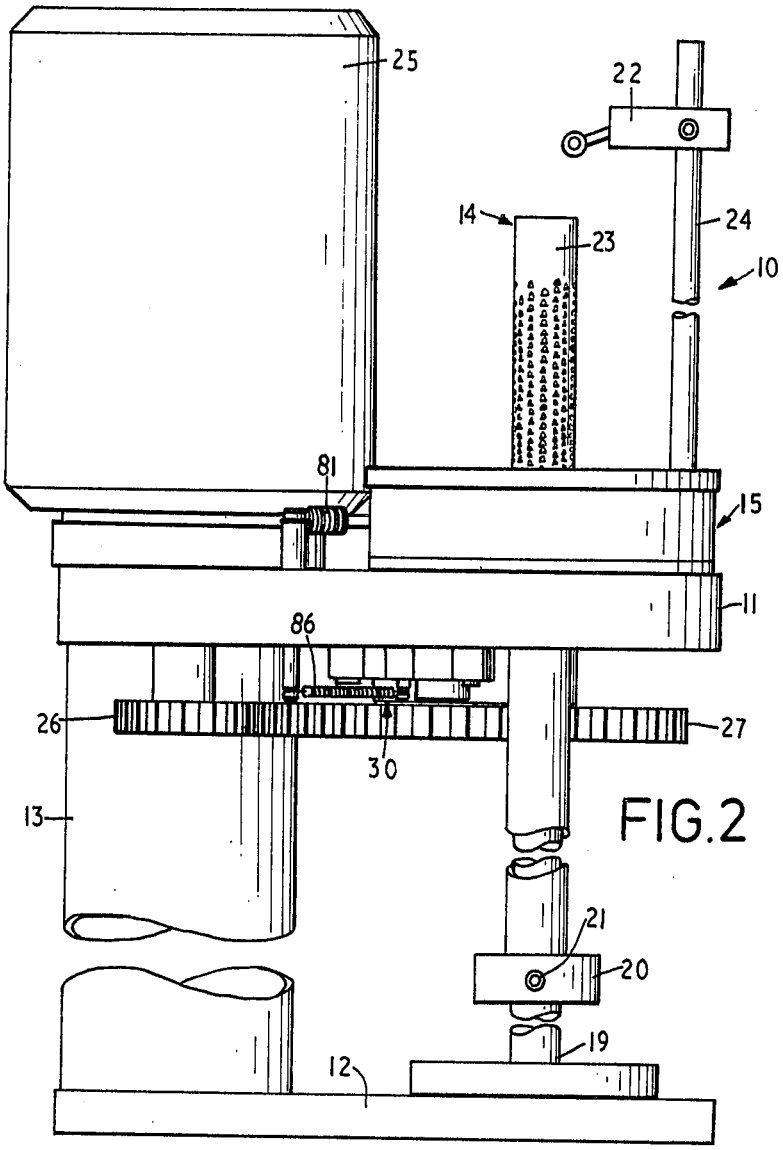
FIG. 2 is a side elevational view of the tube louvering machine.

Referring firstly to FIG. 2, there is illustrated a tube louvering machine 10 having a mounting plate 11 supported above a base 12 by a support column 13. The mounting plate 11 is located at a convenient height above the base 12 to allow an operator to insert and remove tubes 14 respectively into and from a louver head assembly 15 which is secured to the mounting plate 11. The tubes 14 are machined in a vertical position as shown in the drawings to minimise floor space requirements for the machine. However those skilled in the art will appreciate that the machine may be adapted for operation in the horizontal mode.

Figure 3:
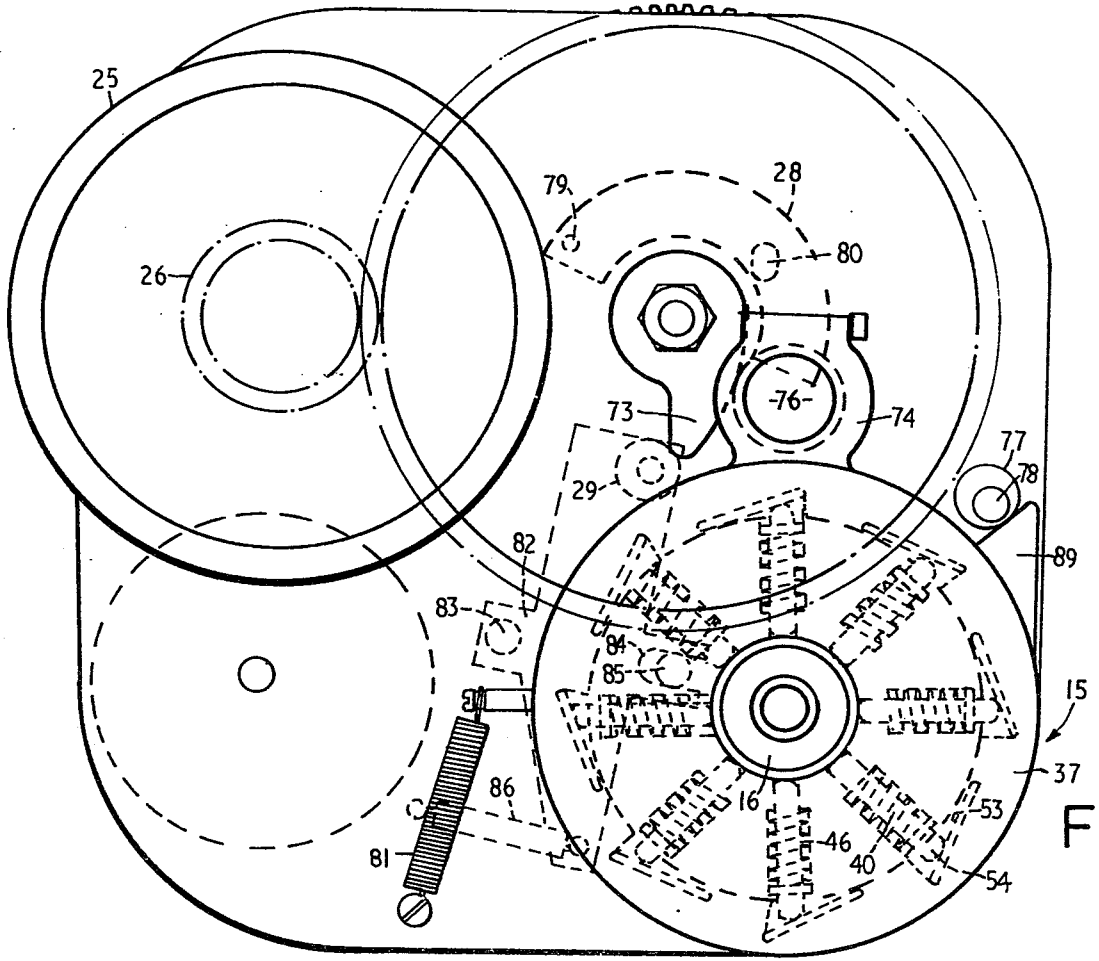
FIG. 3 is a plan view of the tube louvering machine illustrated in FIG. 2.
Figure 4:
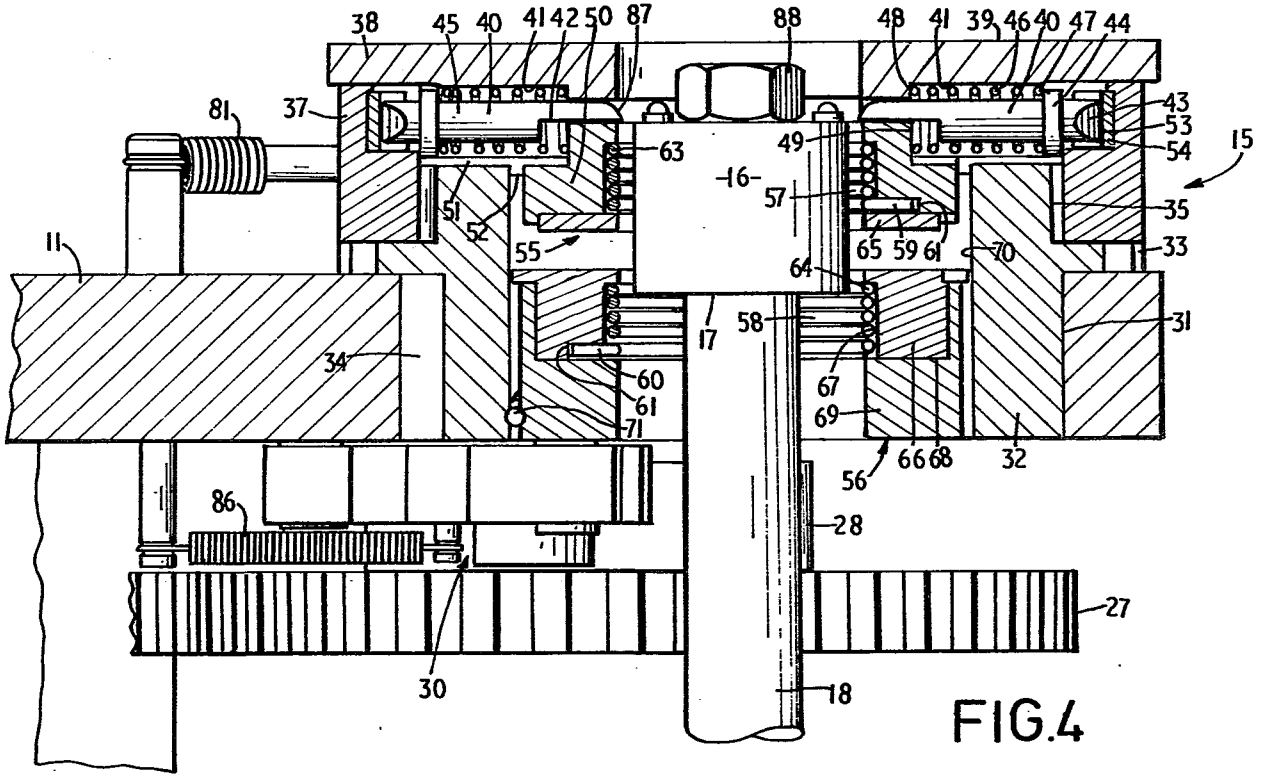
FIG. 4 is a sectional arrangement of the head assembly shown in FIG. 1 and its drive.

As shown in FIGS. 3 and 4 a punch shear mandrel 16 is located in the louver head assembly 15 and is mounted on one end 17 of a mandrel support shaft 18, the other end 19 of which is secured to the machine base 12. A length stop 20 is slidably mounted on shaft 18 and can be locked at a set position by set screw 21. For a given length of tube to be louvered, length stop 20 and length limit switch 22 are set for louvering of a centre portion only of the tubes to leave short unlouvered portions 23 at ends of the tubes 14. The unlouvered portions 23 are those portions of a complete exhaust muffler which extend from the muffler for connection to an exhaust pipe system. The length limit switch 22 is adjustably mounted on a length stop bar 24 which extends vertically upwards from mounting plate 11. The louver head assembly and the tube feed are driven by a common motor 25, also mounted on plate 11, through driving and driven gears 26 and 27 respectively. Attached to driven gear 27 is an adjustable feed cam 28 which contacts feed cam roller 29 to operate feed actuator assembly 30, as shown in FIG. 2.

Figure 1:
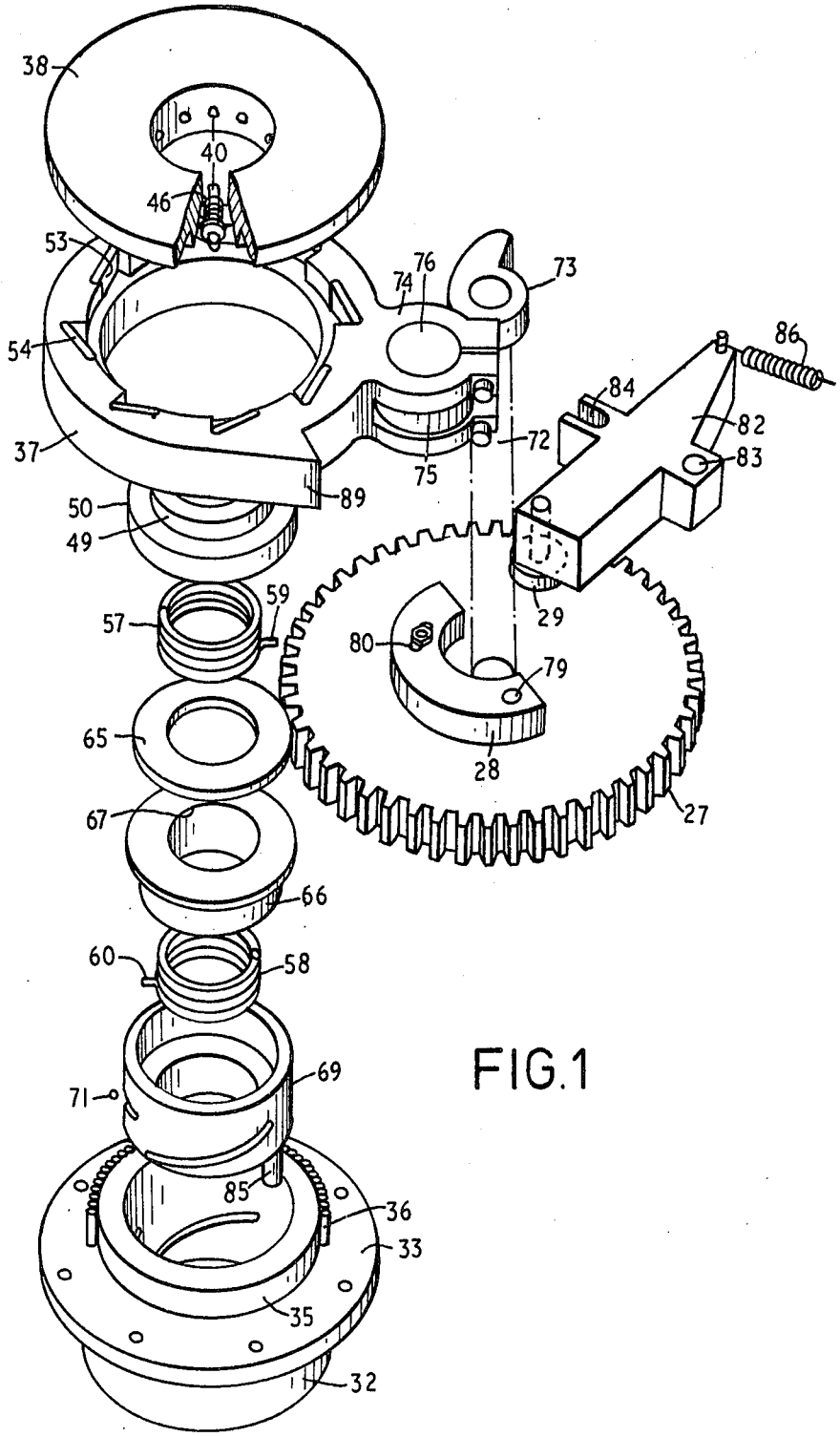
FIG. 1 is an exploded view of a louver head assembly of a tube louvering machine in accordance with the present invention.

Referring now to FIGS. 1 and 4, the louver head assembly 15 is shown in greater detail. The mounting plate 11 is formed with a bore 31 in which is located with a neat fit head core 32. The core 32 is secured to the mounting plate 11 by bolting flange 33 of the core to the plate 11, the core being rotationally retained by means of key 34 in adjacent mating grooves in core 32 and plate 11. The end of the head core 32 remote from the mounting plate 11 is spigotted to form a bearing surface 35 about which there is located a plurality of punch head rollers 36. Supported for rotation on rollers 36 is a substantially annular punch drive head 37 which is sandwiched between flange 33 of core 32 and an inside surface of a punch plate 38 with a neat sliding fit. The punch plate 38 is bolted to core 32, the bolts being accessible from the front face 39 of plate 38 for easy removal of plate 38 and punches 40. The inside surface of plate 38 has formed therein eight radial slots 41 sized and shaped to receive eight high speed steel punches 40.

Each punch 40 includes a shank 45, a cutting edge 87, a guide surface 42 adjacent the cutting edge 87, a semicircular ramp contact portion 43, a flange 44 adjacent portion 43 on shank 45. A punch return spring 46 is located on shank 45 of the punch, one end 47 of the spring abuts punch flange 44 and the other end 48 abuts spigot portion 49 of an annular punch guide and feed spring retainer 50. An annular alignment and spacer plate 51 having a concentric alignment spigot 52 is provided for maintaining the position of retainer 50 with respect to core 32 and punch plate 38. The spacer plate 51 also retains rollers 36 in position on the bearing surfaces of core 32 and punch drive head 37. The punch guide and feed spring retainer 50 is fixedly secured to punch plate 38, which as previously mentioned, is bolted to core 32. Punch drive ramps 53 are formed in the drive head 37 by securing inclined hardened inserts 54 to the inside of the annular drive head. The ramps 53 are positioned to bear on contact portions 43 of punches 40 and, upon rotation of head 37, the punches are simultaneously moved radially inwards to form louvered openings in a tube. On reversing the rotational movement of head 37, the punches 40 are biased to a retracted position by return springs 46. The mandrel 16, which is fabricated of tool steel, is sized to slide within the tube and support the tube during the punching operation. End 88 of the mandrel is preferably set back a small amount (0.010 inch) from cutting edges 87 and guide surfaces 42 of retainer 50.

Turning now to the mechanism for feeding a tube 14 through the punch head assembly, it is to be noted that the feed is intermittent, otherwise damage would occur to the punches and other components of the machine if the tube was fed forward while the punches were located in holes just formed in the tube. Feed of the tube is achieved by means of a fixed tube holding devide 55 and a travelling tube holding device 56. The travelling holding device 56 grips the tube to index it forward and while that travelling device is returning, the fixed tube holding device 55 grips the tube to prevent it from moving backwards with the return stroke of the travelling device.

The fixed and travelling tube holding devices 55 and 56 both incorporate a coil spring 57 and 58, through which the tube passes with, in their relaxed state, a slight interference fit. One end of each spring (57 and 58) is provided with radially extending protrusion (59 and 60) which locates in a slot (61 and 62) to prevent the spring from rotating. The other end (63 and 64) of each coil spring (57 and 58) is free to rotate. Fixed spring 57 is retained in its housing 50 by an annular keeper 65. The travelling spring 58 is located in a socket 67 in housing 66 which is mounted in a socket 68 of feed nut 69. Bore 70 of core 32 is machined to provide a three start coarse pitch ball groove. The feed nut 69 is mounted on balls 71 in the grooves formed in bore 70 to cause it to move forward towards the punch plate 38 upon rotation of the nut in a clockwise direction when viewed from the punch plate. The springs 57 and 58 are of opposite hand. When viewed from the ends having the radial protrusions 59 and 60, spring 57 spirals away from the viewer in a clockwise direction and spring 58 in an anticlockwise direction.

Accordingly following insertion of a tube into the machine, the forward twisting movement of feed nut 69 causes spring 58 to tighten on the tube and cause it to move forward also with a twisting action. That twisting action of the tube causes spring 57 to unwind sufficiently to allow the tube to slide forward through the spring 57. On return of the feed nut, the rotational movement of the nut causes spring 58 to release its grip and spring 57 to tighten onto the tube to prevent it from moving backwards.

Referring now to the drive and feed actuator mechanisms, motor 25 is connected to driving gear 26 which meshes with driven gear 27 which is positioned on the underside of mounting plate 11. Driven gear 27 is connected by shaft 72 to punch cam 73 which is located on the upper side of mounting plate 11 adjacent louver head assembly 15. Punch drive ring 37 includes, radially extending from an outer peripheral surface thereof, a cam roller arm 74 supporting a cam roller 75 rotatably mounted on an eccentric shaft 76, and a shoulder 89. When drive ring 37 is returned by spring 81 to its punch-retracted position, shoulder 89 abuts return stop 77, which is also mounted on an eccentric shaft 78. By adjustment of the rotational position of roller shaft 76 and return stop shaft 78 the angular travel of punch drive ring 37 can be set to suit machining requirements, the maximum travel of the ring in the embodiment illustrated being approximately 20°.

Also attached to the driven gear 27 is a feed cam 28 which is pivotable about pin 79 and which is secured in a selected position by means of a locking bolt in slot 80. Feed cam 28 during rotation of gear 27 contacts roller 29 to rock feed actuator lever 82 which is pivotable about pin 83. Lever 82 includes an open ended slot 84 within which pint 85 locates with a sliding fit, pin 85 being secured to a peripheral radial face of feed nut 69. Upon retraction of feed cam 28, lever 82 is returned to its initial position by bias spring 86. The length of pin 85 and the depth of slot 84 are sized to allow pin 85 to slide forward in slot 84 when nut 69 is travelling foward while maintaining engagement with each other.

In operation, the tube to be louvered is cut to a predetermined length deburred inside and out and pushed through the front of the machine with a slight twisting motion (this is necessary to overcome the drag of the holding devices 55 and 56) the tube passes over the mandrel 16 to preset stop 20 on the mandrel support shaft 18.

The motor is started which revolves the cam shaft 72 causing the punch head 37 to be rotated through an arc of up to 20°. The punch ramps 54 force the punches 40 towards the centre, shearing into the tube with the mandrel 16 as support to give a clean cut. As the cam 73 reaches the end of its stroke the punch head 37 returns to its initial position, the punch springs retracting the punches. At this point the feed cam 28 rises onto the feed cam roller 29 forcing the lever 82 to pivot, which causes the feed nut 69 to rotate. The feed spring 58 grips the tube and feeds it forward and around in a spiral action. At the end of the feed stroke the hold spring 57 grips the tube and the feed nut returns to the start position.

This action continues until the required length of tube is louvered.

What I claim is:

1. An apparatus to punch a plurality of holes in a tubular workpiece comprising: a body, a plurality of punches slidably mounted on said body, said punches being angularly spaced around said tubular workpieces; punch actuating means to cause simultaneous reciprocal movement of said plurality of punches to form a plurality of holes in said workpiece, said punch actuating means including support and guide means for said punches restraining said punches to move in a radial direction with respect to the workpiece, a punch actuating member to surround said workpiece and having a plurality of punch engaging surfaces to engage the punches to cause movement thereof, said member being rotated about the longitudinal axis of the workpiece to cause radial inward movement of said punches to pierce said workpiece by said surfaces being inclined to the direction of movement of the punches, and means biasing said punches to engage said surfaces; gripping means for holding and intermittently moving said tubular workpiece; said gripping means including a fixed tube holding device and a travelling tube holding device reciprocally movable between an extended and a retracted position, said fixed tube holding device being adapted to holdingly engage said workpiece during a punching operation and allow movement of the workpiece axially in between punching operations, and said travelling tube holding device being adapted to engage said workpiece when moving from said retracted position to said extended position to axially move said workpiece in between punching operations; drive means for said gripping means and said punch actuating means, said drive means including co-ordination means for sequentially causing the movement of said travelling tube holding device and actuation of said punch actuating means, said co-ordination means including a driven member to be rotated continuously in a predetermined direction during operating of the apparatus, first engagement means fixed to said driven member so as to be moved therewith and adapted to engage said punch actuating member to cause the rotation thereof, and second engagement means fixed to said driven member so as to be moved therewith to cause the reciprocation of said travelling tube holding device.

2. The apparatus of claim 1 wherein said punch actuating means has projecting from it an abutment, and said first engagement means is a cam which engages said abutment to rotatably reciprocate said actuating member.

3. The apparatus of claim 2 wherein said abutment is a cam engaging roller, and said apparatus further comprises a shaft rotatably supporting said roller to provide adjustment means supporting said shaft adapted to selectively relocate said shaft for adjustment of said roller with respect to said cam.

4. The apparatus of claim 1 wherein the fixed tube holding device includes a fixed spring wound around the workpiece, and the travelling tube holding device including a movable spring wound around the workpiece at a position spaced longitudinally with respect to the workpice from the fixed spring, the springs in their relaxed state having a slight interference fit with the workpiece.

5. The apparatus of claim 4 wherein said fixed tube holding device further includes a fixed means holding one end of the fixed spring stationary, said travelling tube holding device further includes movable means for holding one end of said movable spring, spring actuacting means to cause simultaneous rotation in a predetermined direction and axial movement toward the fixed means of said movable means to cause rotation of and axial movement of said movable spring, and wherein each of the springs has a free end and the springs have different winding directions so that rotation of said movable spring in said predetermined direction causes said movable spring to grip the workpiece and rotate the workpiece as it is moved axially by the axial movement of said movable spring, while rotation of said workpiece causes unwinding of said fixed spring sufficiently to allow the workpiece to slide through said fixed spring.

6. The apparatus of claim 5 wherein said spring actuating means comprises at least a three start coarse pitch ball groove in said movable means which surround the workpiece, a stationary member provided with a groove or grooves adjacent the grooves of the movable means, a ball located in each of the grooves so that said movable means is caused to move axially by the rotation of said movable means, and wherein said movable means is reciprocally rotatably moved by said second engagement means.

7. The apparatus of claim 6 wherein said spring actuating means further includes a projection of said movable means, a pivoted member with a slot, and said second engagement means is a cam causing reciprocal pivoting movement of said pivoted member, and wherein said projection is located in said slot so that the reciprocation of said pivoted member causes the reciprocal rotation of said movable member.

8. The apparatus of claim 1 wherein said travelling tube holding device includes a movable manner, tube engaging means mounted on the movable member to selectively engage the workpiece.

9. The apparatus of claim 8 wherein said drive means includes movement producing means to engage and longitudinally move said movable means.

10. The apparatus of claim 9 wherein said movement producing means also causes rotation of said movable means to thereby rotate said workpiece about its longitudinal axis.

11. The apparatus of claim 10 wherein said movement producing means includes at least a three start coarse pitch ball groove in said movable member, a stationary member adjacent said movable member, a groove in said stationary member corresponding to each of the grooves of said movable member, a ball for each corresponding pair of grooves engaged with each of the pair, means to cause reciprocating rotation of said movable member, wherein the grooves are located and arranged so that the reciprocating rotation of said movable member produces the longitudinal movement thereof by the engagement of the balls within the grooves.

12. The apparatus of claim 9 wherein said movable means includes a projection and said drive means includes a pivoted member with a slot, a driven cam causing reciprocating pivoting movement of said pivoted member, and wherein said projection is located in said slot so that the reciprocation of said pivoted member causes reciprocating rotation of said movable means.

13. An apparatus comprising: a body, gripping means on said body for holding a tubular workpiece; a plurality of punches slidably mounted on said body, said punches being angularly spaced around said tubular workpiece; punch actuating means causing movement of said plurality of punches towards said workpiece to form a plurality of holes therein, said punch actuating means comprises a punch actuating member to surround said workpiece and having a plurality of punch engaging surfaces, said member being rotatable about the workpiece to cause radial inward movement of said punches to pierce said workpiece by said surfaces being inclined to the direction of movement of the punches, driven means to rotatably reciprocate said punch actuating member between a punch extended position and a punch retracted position to cause actuation of said punches, said member having a cam engaging roller, said driven means includes a cam engaging said roller to reciprocate said actuating member, and a shaft rotatably supporting said roller, adjustment means supporting said roller adapted to selectively relocate said shaft to provide for adjustment of said roller with respect to said cam; support and guide means for said punches restraining said punches to move in a radial direction with respect to the workpiece.

14. An apparatus comprising: a body; gripping means on said body for holding a tubular workpiece; a plurality of punches slidably mounted on said body, said punches being angularly spaced around said tubular workpiece; and punch actuating means causing movement of said plurality of punches towards said workpiece to form a plurality of holes therein; said punch actuating means including an actuating member to surround said workpiece and rotatable about the longitudinal axis of the workpiece, said actuating member having a plurality of punch engaging surfaces, said surfaces and punches being equally angularly spaced around the workpiece so that the punches are actuated simultaneously by engagement thereof by said surfaces; said gripping means comprises a fixed tube holding device and a travelling tube holding device, said fixed tube holding device being adapted to holdingly engage said workpiece during a punching operation and allow movement of the workpiece axially in between punching operations; and said travelling tube holding device being adapted to engage said workpiece and move it axially in between punching operations, said fixed tube holding device includes a fixed spring wound around the workpiece, the travelling tube holding device including a movable spring wound around the workpiece at a position spaced longitudinally from the fixed spring, the springs in their relaxed state having a slight interference fit with the workpiece, said fixed tube holding device further includes a fixed means holding one end of the fixed spring stationary, said travelling tube holding device further includes movable means for holding one end of said movable means for holding one end of said movable spring, spring actuating means to cause simultaneous rotation in a predetermined direction and axial movement toward the fixed tube holding device of said movable means to cause rotation of and axial movement of said movable spring, and wherein each of the springs has a free end and the spring have different winding directions so that rotation of said movable spring in said predetermined direction causes said movable spring to grip the workpiece and rotate the workpiece as it is moved axially by the axial movement of said movable spring, while rotation of said workpiece causes unwinding of said fixed spring sufficiently to allow the workpiece to slide through said fixed spring.

15. The apparatus of claim 14 wherein said punch actuating means includes driven means to rotatably reciprocate said punch actuating member between a punch extended position and a punch retracted position to cause actuation of said punches and an abutment; and said driven means includes a cam which engages said abutment to reciprocate said actuating member.

16. The apparatus of claim 15 wherein said spring actuating means comprises at least a three start coarse pitch ball groove in said travelling spring holding means which surround the workpiece, a stationary member surrounding said movable means, said stationary member also being provided with a groove or grooves adjacent the grooves of the movable means, a ball located in each of the grooves so that said movable means is caused to move axially by the rotation of said movable means, and means to rotate said movable means including a projection on said movable means, a pivoted member with a slot, a driven cam causing reciprocating pivoting movement of said pivoted member, and wherein said projection is located in said slot so that the reciprocation of said pivoted member causes rotation of said movable means.

17. The apparatus of claim 16 further comprising synchronising means to co-ordinate the cam of said driven means and the cam of said means to drive said movable means.

* * * * *